US008701918B2

(12) United States Patent
Alvares et al.

(10) Patent No.: US 8,701,918 B2
(45) Date of Patent: Apr. 22, 2014

(54) METALLIC LID FOR A CAN

(75) Inventors: Antonio Carlos Teixeira Alvares, Sao-Paulo (BR); Antonio Roberto Sene, Sao Paulo (BR)

(73) Assignee: Brasilata S/A Embalagens Metálicas, Sao Paulo (BR)

( * ) Notice: Subject to any disclaimer, the term of this patent is extended or adjusted under 35 U.S.C. 154(b) by 396 days.

(21) Appl. No.: 11/720,459

(22) PCT Filed: Nov. 25, 2005

(86) PCT No.: PCT/BR2005/000241
§ 371 (c)(1), (2), (4) Date: Oct. 17, 2007

(87) PCT Pub. No.: WO2006/058397
PCT Pub. Date: Jun. 8, 2006

(65) Prior Publication Data

US 2008/0173656 A1 Jul. 24, 2008

(30) Foreign Application Priority Data

Dec. 2, 2004 (BR) ..... 0405458

(51) Int. Cl.

| | |
|---|---|
| ***B65D 43/08*** | (2006.01) |
| ***B65D 51/18*** | (2006.01) |
| ***B65D 43/03*** | (2006.01) |
| ***B65D 39/00*** | (2006.01) |
| ***B65D 41/16*** | (2006.01) |
| ***B65D 43/04*** | (2006.01) |

(52) U.S. Cl.
USPC ..... 220/254.7; 220/781; 220/789; 220/794; 220/796; 220/801

(58) Field of Classification Search
USPC ..... 220/796, 254.7, 781, 789, 794, 801
See application file for complete search history.

(56) References Cited

U.S. PATENT DOCUMENTS

| | | | | | |
|---|---|---|---|---|---|
| 795,126 | A | | 7/1905 | Hodgson | |
| 2,074,231 | A | | 3/1937 | Meacham | |
| 3,347,408 | A | * | 10/1967 | Baker | 220/789 |
| 4,090,636 | A | * | 5/1978 | Norton | 220/789 |
| 4,171,063 | A | * | 10/1979 | Cloutier | 220/789 |
| 4,180,179 | A | * | 12/1979 | Hoenig et al. | 220/783 |

(Continued)

FOREIGN PATENT DOCUMENTS

| | | |
|---|---|---|
| BR | PI9408643-5 | 11/1995 |
| BR | MU7601221-2 | 7/1998 |

(Continued)

*Primary Examiner* — Anthony Stashick
*Assistant Examiner* — Andrew T Kirsch
(74) *Attorney, Agent, or Firm* — Fish & Richardson P.C.

(57) ABSTRACT

A metallic lid for a can of the type which presents an opening defining a seating, said lid comprising, in a single piece, a bottom wall which incorporates, superiorly and peripherally, a side wall provided with a free upper edge and designed to be frictionally seated and axially retained in the interior of the seat. According to the invention, the bottom wall comprises a peripheral annular portion adjacent to the side wall, a median portion and an annular rib portion having the cross section in the approximate form of an inverted 'U', with the free edges of is lateral legs being respectively incorporated to the adjacent edges of the peripheral annular portion and median portion of the bottom wall.

7 Claims, 3 Drawing Sheets

(56) References Cited

U.S. PATENT DOCUMENTS

| | | | | |
|---|---|---|---|---|
| 4,606,474 | A * | 8/1986 | Dudzik | 220/781 |
| 5,339,977 | A * | 8/1994 | Schormair et al. | 220/789 |
| 5,899,352 | A * | 5/1999 | Guarda et al. | 220/254.1 |
| 6,085,934 | A | 7/2000 | Sene et al. | |
| 6,675,983 | B1 * | 1/2004 | Alvares et al. | 220/254.1 |
| 2003/0141311 | A1 * | 7/2003 | Ceolin et al. | 220/701 |
| 2003/0168465 | A1 * | 9/2003 | Breimon et al. | 220/783 |
| 2007/0080159 | A1 * | 4/2007 | Alvares et al. | 220/254.7 |

FOREIGN PATENT DOCUMENTS

| | | |
|---|---|---|
| BR | MU8002618-4 | 6/2001 |
| BR | MU8002622-2 | 6/2001 |
| DE | 8903754 U1 | 6/1989 |

* cited by examiner

METALLIC LID FOR A CAN

CROSS REFERENCE TO PRIOR APPLICATION

This application is the U.S. national phase of International Application No. PCT/BR2005/000241, filed Nov. 25, 2005, which claims priority from Brazilian Patent Application No. PI0405458-0, filed Dec. 2, 2004, the disclosure of both are incorporated herein by reference in their entirety.

FIELD OF THE INVENTION

The present invention refers to a metallic lid of the type having a peripheral side wall provided with a free upper edge and which is designed to be frictionally seated and axially retained in the interior of a seat defined in an upper opening of the can.

BACKGROUND OF THE INVENTION

Metallic lids of the type mentioned above are well known. They are formed in a single piece of metal sheet and comprise a generally disk shaped bottom wall, whose peripheral edge incorporates a side wall projecting upwardly, so as to be removably press fitted and axially retained inside a seat defined in an upper opening of a can. Said seat can be defined by a depending tubular projection which is superiorly incorporated to a median opening of the upper wall of a can with a circular or polygonal section.

Metallic lids of the type mentioned above are disclosed and illustrated in U.S. Pat. No. 2,074,231, U.S. Pat. No. 3,347,408, BR-MU8002622-2, BR-MU8002618-4, BR-PI9408643-5 and BR-MU7601221-2, the last two pertaining to the same applicant of the present patent application.

In these prior art constructions, the lid structure comprises only the bottom wall and a peripheral side wall, and the axial retention of the lid in the seat defined in the upper opening of the can is usually achieved through engaging means provided in at least one of the parts defined by the parts of lid side wall and seat in the upper opening, in order to operate with the other part.

In the construction above, even when the bottom wall of the lid presents a drawn or raised median portion, as taught in the solution disclosed in patents BR-MU7601221-2 and U.S. Pat. No. 3,347,408, the lid structure requires certain cares to be taken when closing forces are applied, otherwise the lid can be irremediable damaged, avoiding a tight and secure closure of the can.

The structural deficiency mentioned above is due to the fact that said lid construction lacks the usual peripheral strength guaranteed in the metallic lids provided with a peripheral annular recess, generally with an inverted substantially trapezoidal cross section, to be frictionally seated in the interior of a recess with a complementary cross section an which defines a seat incorporated to the annular upper wall of a can body, such as in the construction known for decades and which is disclosed and illustrated in U.S. Pat. No. 795,126, filed in 1904.

In this very well known construction, the structure of the lid allows the latter to be pressed when placed on the upper annular wall of the can, without the risk of producing plastic deformations in the profile of the lid, preventing the latter from being tightly retained in its seat in the can.

The construction of the peripheral recess, jointly with its region to which the raised median portion of the lid is joined, imparts a high structural strength to said lid, allowing the users to close the can by seating the lid and applying force in different locations in the lid, without the risk of the lid being deformed or losing its original shape.

SUMMARY OF THE INVENTION

As a function of the deficiencies cited above and related to the metallic lids provided with a side wall to be frictionally seated and axially retained inside a seat defined in an opening of the can, it is an object of the present invention to provide a metallic lid of the type considered herein, which presents a higher structural strength, allowing it to be adequately and correctly closed, without requiring special cares when axial compressive forces are applied upon fitting the lid in the respective seat. This and other objects and advantages of the present invention are attained by providing a metallic lid of the type mentioned above, which has its bottom wall comprising a peripheral annular portion, adjacent to the side wall of the lid, a median portion and an annular rib portion having a cross section having the approximate form of an inverted "U", with the free edges of its lateral legs being respectively incorporated to the adjacent edges of the peripheral annular portion and the median portion of the bottom wall.

With the construction generically defined above, the median portion and the peripheral annular portion of the bottom wall of the can are joined to each other through said annular rib portion, which projects preferably upwardly from said median and peripheral annular portions of the bottom wall, defining a structural element incorporated to the bottom wall itself and spaced from the side wall by a radial distance corresponding to the radial width of the peripheral annular portion of the bottom wall.

The provision of the annular rib portion imparts to the lid a structural strength that is substantially higher than that achieved with the prior art constructions mentioned above, with no need of increasing the thickness of the metal sheet that forms the lid.

Moreover, the construction of the lid object of the present invention can be achieved so as to maintain the median portion of the bottom wall in a higher plane in relation to the plane containing the peripheral annular portion of said bottom wall, allowing the median portion, jointly with the annular rib portion, to operate as a seating element for placing one lid over the other, when lids are stacked in a lid feeding device of a can closing machine.

BRIEF DESCRIPTION OF THE DRAWINGS

The invention will be described below, with reference being made to the enclosed drawings, by way of examples of a possible construction for the present lid, and in which.

DETAILED DESCRIPTION OF THE INVENTION

Figure 1:
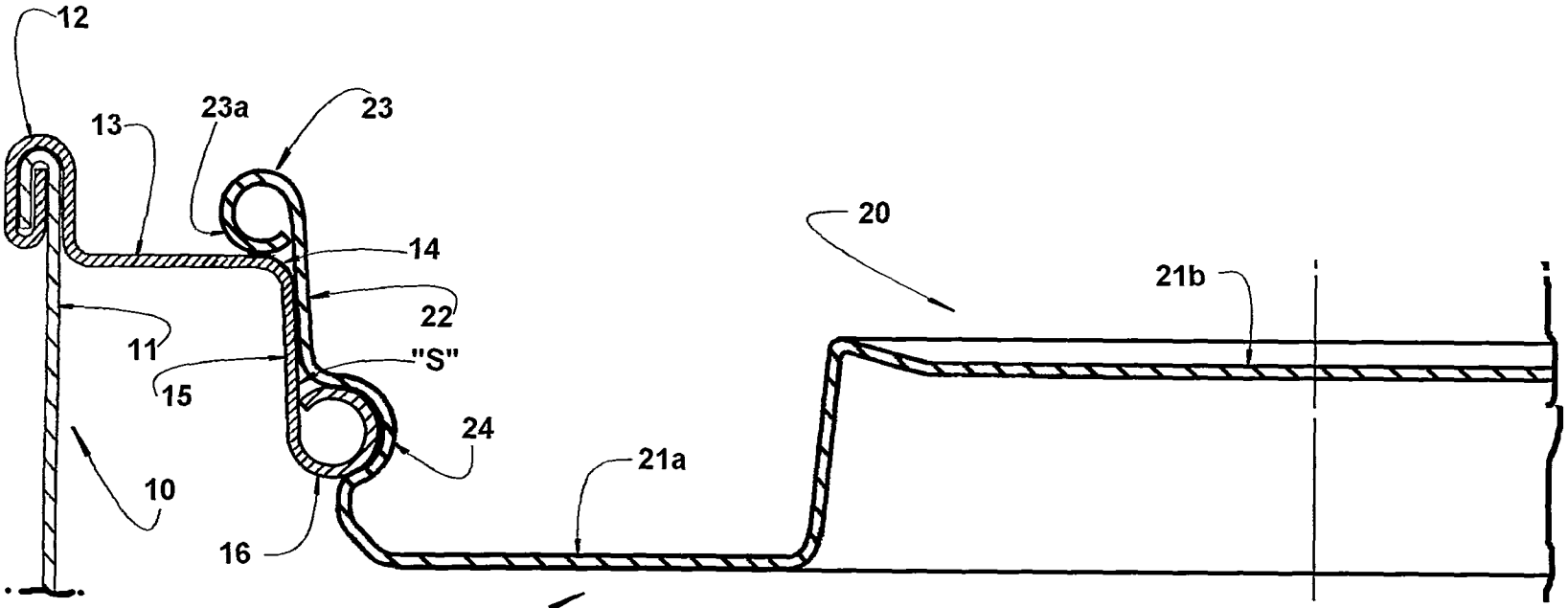
FIG. 1 PRIOR ART
FIG. 1 is a partial diametrical sectional view of the upper region of a can, in whose discharge end opening is fitted a lid constructed according to the known prior art solutions.

As illustrated in the appended drawings, the lid of the present invention is applied to a can 10, which is graphically illustrated only by the upper portion of its side wall 11, to whose upper edge 12 is affixed, usually by a double seam 12, an external peripheral edge of an annular upper wall 13 in whose median region is provided an opening 14 to whose edge is incorporated a depending tubular projection 15 which defines a seat (S) for the lid of the can. In the prior art construction shown in FIG. 1 of the drawings and which is object of Brazilian patent BR-PI 9408643-5 of the applicant of the present invention, the depending tubular projection 15 is provided with a lower end portion that is bent inwardly the opening 14, then upwardly and against the depending tubular projection 15, so as to form a continuous tubular rib 16 which can have, for example, a circular shape, as described in said prior art patent.

However, it should be understood that the construction of the depending tubular projection 15 of the annular upper wall 13 of the can 10 may have different constructive arrangements, as illustrated and discussed in the prior art documents mentioned above, without said constructive modifications altering the constructive and functional objectives of the present invention.

As mentioned above, the lid 20 of the present invention is formed in a single piece of metal sheet, comprising a bottom wall 21 usually in the form of a flat disk and which incorporates, superiorly and peripherally, a side wall 22 provided with a free upper edge 23 and designed to be frictionally seated and axially retained inside the seat "S" defined by the depending tubular projection 15 of the opening 14 provided in the annular upper wall 13.

In the exemplary construction shown in the drawings, the lid 20 has its side wall 22 provided with a continuous peripheral recess 24, inside which is sealingly fitted and axially retained the continuous tubular rib 16 of the depending tubular projection 15. In the illustrated construction, both the continuous annular rib 16 of the depending tubular projection 15 and the continuous peripheral recess 24 of the side wall 22 of the lid 20 present a contour which is at least partially circular and complementary, so that the mutual seating of said parts promotes not only the axial retention of the lid 20 in the opening 14 of the can 10, but also a sealing effect in this region of frictional seating. It should be understood, however, that the continuous annular rib 16 and the continuous peripheral recess 24 might present configurations other than the tubular circular one illustrated in the drawings, as shown in the prior art documents mentioned in the beginning of the description.

Still according to the illustrated embodiment, the lid 20 has its free upper edge 23 bent outwardly, downwardly and against the side wall 22, so as to define a tubular upper rib 23*a* to be seated on the annular upper wall 13 of the can 10, in the region that surrounds the opening 14. Accordingly, it should be understood that the free upper edge 23 of the side wall 22 of the lid 20 can have different constructive forms, as illustrated in the prior art documents mentioned above, without said modifications of form and arrangement in the upper region of the side wall 22 of the lid 20 altering the functional characteristics of the invention proposed herein. According to the invention, the bottom wall 21 of the lid 20 comprises a peripheral annular portion 21*a* adjacent to the side wall 22, a median portion 21*b*, which is usually flat and disk shaped, and an annular rib portion 25, whose cross section has the approximate form of an inverted "U", with the free edges of its lateral legs being respectively incorporated to the adjacent peripheral edges of the peripheral annular portion 21*a* and median portion 21*b* of the bottom wall 21.

The annular rib portion 25 is stamped jointly with the remainder of the lid 20, in order to project preferably upwardly from the peripheral annular portion 21*a* and median portion 21*b* of the bottom wall 21. As illustrated, the radial width of the peripheral annular portion (21*a*) of the bottom wall (21) is approximately equal to the height of the side wall (22) of the lid (20), allowing the annular rib portion 25 to be spaced from said side wall 22 by an adequate distance, so as to give to the marginal region of the lid 20 the necessary structural strength to resist the compressive forces to be applied over the lid 20 upon fitting the latter in the opening 14 of the can 10. Still according to the preferred embodiment, the median portion of the bottom wall 21 lies in a higher plane in relation to a plane containing the peripheral annular portion 21*a* of said bottom wall 21. This constructive arrangement allows the median portion 21*b* of the bottom wall 21 to operate jointly with the annular rib portion 25 to define a seating element to place one lid over the other, upon the stacking of said lids in a lid feeding device in an automatic can closing machine, or to allow the lids 20 to be automatically fitted in respective annular upper walls 13 before they are double seamed to the side wall 11 of the cans 10.

Figure 3:
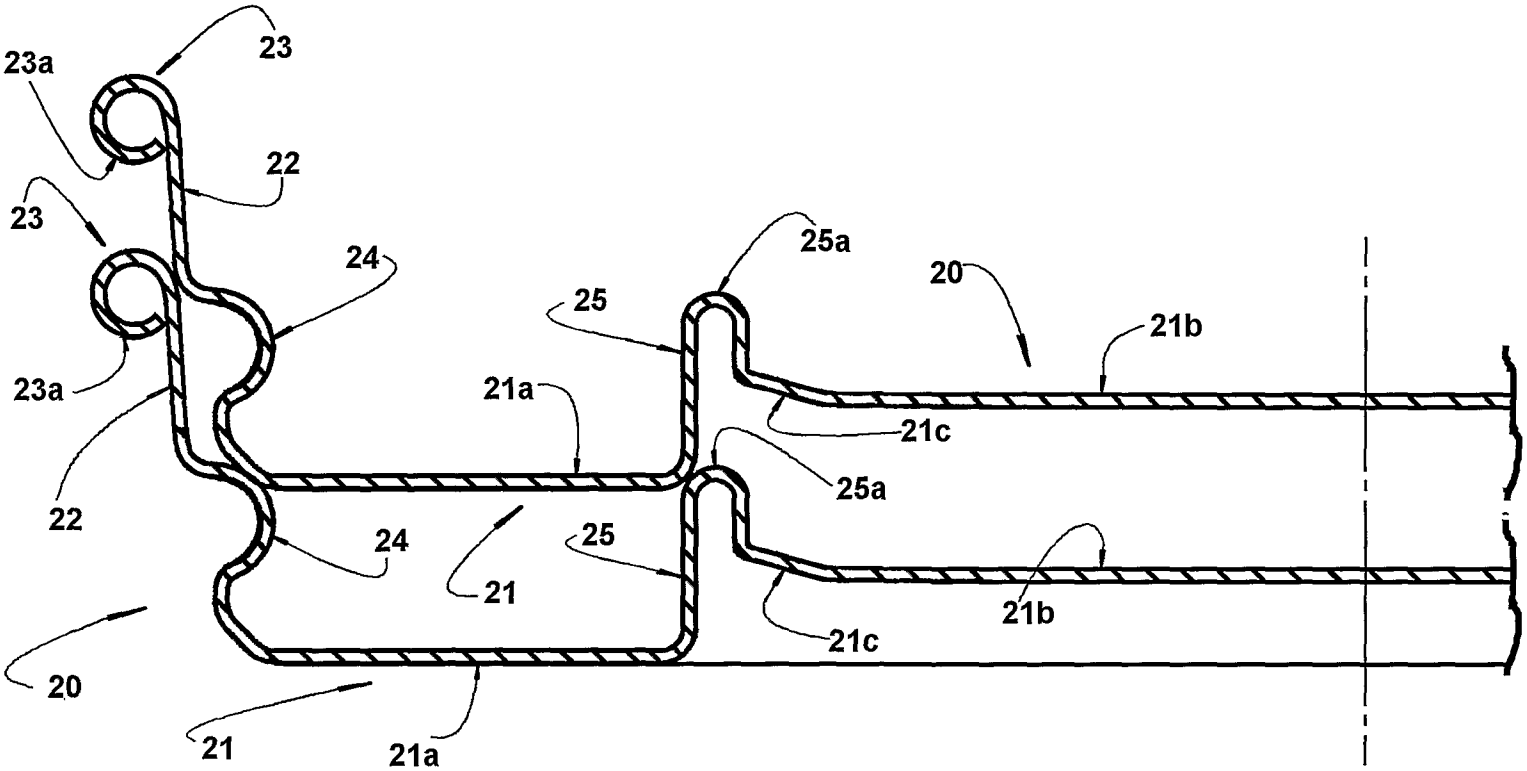
FIG. 3 is a partial diametrical sectional view of a plurality of lids of the present invention when stacked one over the other.

As better shown in FIG. 3, during the stacking of the lids 20, the external and internal peripheral edges of the peripheral annular portion 21*a* are respectively seated on the peripheral recess 24 of the side wall 22 of the lid 20 and on the annular rib portion 25, guaranteeing a mutual seating for the lids 20, with their axes being coaxially disposed and with the free upper edges 23 of the side walls 22 being maintained axially spaced apart.

Figure 2:
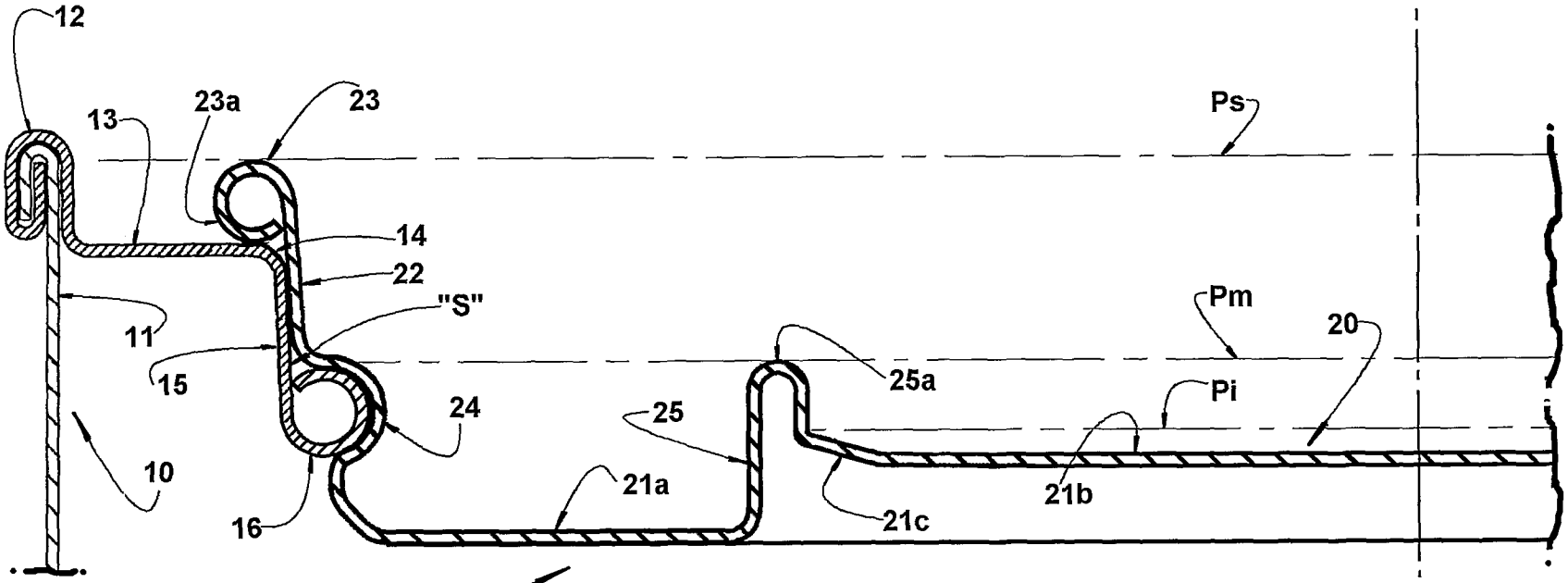
FIG. 2 is a similar view to that of FIG. 1, but illustrating a lid constructed according to the present invention.

The annular rib portion 25 is further constructed and dimensioned in such a way as to lie inferiorly to a plane Ps (FIG. 2) containing the upper free edge 23 of the side wall 22 of the lid 20, such relative dimensioning of the lid parts being made as a function of the stacking characteristics defined in FIG. 3 discussed above.

In the illustrated embodiment, the annular rib portion 25 has an upper edge 25*a* lying in a plane Pm (FIG. 2) which intersects the side wall 22 of the lid 20 usually in the region of the peripheral recess 24 thereof in the constructions in which the side wall 22 has a continuous peripheral recess 24 of the type for receiving a corresponding continuous peripheral rib 16 of the depending tubular projection 15 of the upper annular wall 13 of the can 10. In the illustrated embodiment, the peripheral annular portion 21*a* and the median portion 21*b* of the bottom wall 21 of the lid 20 are flat, said median portion 21*b* of the bottom wall 21 being disposed in a plane that is slightly inferior to a plane Pi (FIG. 2) containing the free lower edge of the adjacent lateral leg of the annular rib portion 25, said median portion 21*b* presenting a marginal annular region 21*c* upwardly and outwardly inclined so as to match said free lower edge of the annular rib portion 25.

While only one embodiment for the lid has been illustrated herein, in conjunction with a seat construction, it should be understood that changes in the form of the components are possible, without departing from the constructive concept defined in the appended claims.

The invention claimed is:

1. A metallic lid for a can having an opening defining a seat onto which will be seated a lid, said lid comprising a bottom wall formed of a single piece, said bottom wall comprising:

superiorly and peripherally, a side wall provided with a continuous peripheral recess and with a free upper edge that is to be frictionally seated and axially retained in the interior of the can seat, a peripheral annular portion adjacent to the side wall, a median portion inward of said peripheral annular portion, and an annular rib portion having an upper edge and a cross section that has the form of an inverted "U", said annular rib portion presenting lateral legs with free edges which are respectively attached to adjacent edges of the peripheral annular portion and the median portion of the bottom wall, wherein the radial width of the peripheral annular portion of the bottom wall corresponds to the length of the lid side wall, so as to give to a marginal region of the lid structural strength to resist compressive forces to be applied to the lid upon fitting the lid into the opening of the can, wherein the annular rib portion projects upwardly from the peripheral annular portion and median portion of the bottom wall, with the upper edge of the annular rib portion lying in a plane that intersects an upper portion of the continuous peripheral recess of the sidewall of the lid, said plane being parallel and superior to a plane of the peripheral annular portion and a plane of the median portion of the bottom wall, wherein the opening is provided in an upper wall of the can and the seat is defined by a depending tubular projection superiorly incorporated to the edge of the opening, said depending tubular projection being provided with a lower end portion bent inwardly the opening, then upwardly and against the depending tubular projection, forming a continuous tubular rib, to be sealingly fitted and axially retained inside the side wall of the lid being provided with the continuous peripheral recess, wherein external and internal peripheral edges of the peripheral annular portion of one lid are respectively seated on a peripheral recess and on an upper edge of an annular rib portion of another similar lid provided immediately below, when said lids are stacked such that the peripheral annular portion of one lid is positioned at substantially the same height as the upper edge of the annular rib portion of the lid provided immediately below, and wherein the peripheral annular portion and the median portion of the bottom wall of the lid are flat.

2. The metallic lid as set forth in claim 1, wherein the plane of the median portion of the bottom wall is higher than the plane of the peripheral annular portion of the bottom wall.

3. The metallic lid as set forth in claim 1, wherein the annular rib portion is disposed inferiorly to a plane containing the free upper edge of the side wall of the lid.

4. The metallic lid as set forth in claim 3, wherein the plane of the median portion of the lid bottom wall is slightly inferior to a plane containing a free lower edge of an adjacent lateral leg of the annular rib portion, said median portion presenting a marginal annular region which is upwardly and outwardly inclined to match said free lower edge of the annular rib portion.

5. The metallic lid as set forth in claim 1 wherein said side wall is at an inclined angle to said peripheral annular portion.

6. The metallic lid as set forth in claim 2 wherein said side wall is at an inclined angle to said peripheral annular portion.

7. The metallic lid as set forth in claim 2 wherein the peripheral annular portion is parallel to the plane of the median portion.

* * * * *